US007047600B2

(12) United States Patent
Muir

(10) Patent No.: US 7,047,600 B2
(45) Date of Patent: May 23, 2006

(54) EGRESS 4-BAR HINGE ASSEMBLY

(75) Inventor: Malcolm Muir, Honeoye Falls, NY (US)

(73) Assignee: Advantage Manufacturing Corporation, Victor, NY (US)

( * ) Notice: Subject to any disclaimer, the term of this patent is extended or adjusted under 35 U.S.C. 154(b) by 102 days.

(21) Appl. No.: 10/619,108

(22) Filed: Jul. 14, 2003

(65) Prior Publication Data

US 2005/0011049 A1 Jan. 20, 2005

(51) Int. Cl.
*E05D 15/40* (2006.01)

(52) U.S. Cl. ..... 16/366; 16/370; 16/371; 16/346; 49/246

(58) Field of Classification Search ..... 16/361–366, 16/370, 371, 346, 347, 374, 368, 369, 228, 16/193, 93 R, 268, 269; 49/246, 247, 253, 49/248, 250, 252, 324, 333, 335, 339, 341, 49/345; 403/161, 150, 154; 292/263, 202–204, 292/262, 265, 267, 275
See application file for complete search history.

(56) References Cited

U.S. PATENT DOCUMENTS

| | | | | |
|---|---|---|---|---|
| 3,838,537 | A | 10/1974 | Stavenau et al. | |
| 4,364,201 | A | 12/1982 | Taylor | |
| 4,571,776 | A | 2/1986 | Taylor | |
| 4,674,149 | A * | 6/1987 | Vetter | 16/341 |
| 5,083,344 | A * | 1/1992 | Pettit et al. | 16/254 |
| 5,093,960 | A | 3/1992 | Pemberton | |
| 5,711,052 | A * | 1/1998 | Delaske | 16/364 |
| 5,898,977 | A | 5/1999 | Muir | |
| 6,434,887 | B1 * | 8/2002 | Nakanishi et al. | 49/246 |
| 6,442,898 | B1 * | 9/2002 | Wu | 49/246 |
| 2003/0213100 | A1 * | 11/2003 | Brain et al. | 16/361 |

* cited by examiner

*Primary Examiner*—Robert J. Sandy
*Assistant Examiner*—Michael J. Kyle
(74) *Attorney, Agent, or Firm*—Brian B. Shaw, Esq.; Thomas B. Ryan; Harter, Secrest & Emery LLP

(57) ABSTRACT

An egress 4-bar hinge assembly having two load-bearing links that pivot about spaced-apart bearing pivot points, wherein an entire length of at least one of the links overlies a planar bearing surface. The two links include a cooperating interface selected to engage through only a portion of the respective range of motions. The hinge assembly includes a support extension to define the bearing surface, wherein the support extension can include an integral end cap.

15 Claims, 5 Drawing Sheets

DETAIL A
Full-Closed Position

DETAIL A
Full-Open Position

DETAIL A
Semi-Open Position

FIG. 7
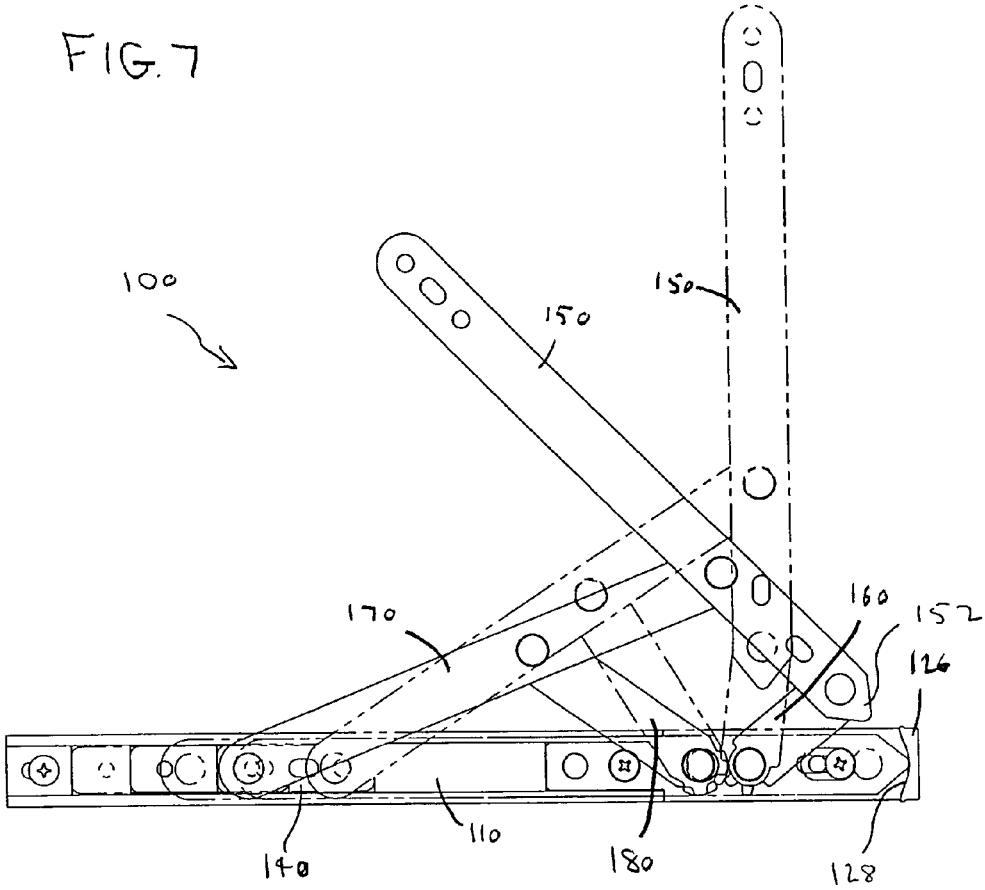
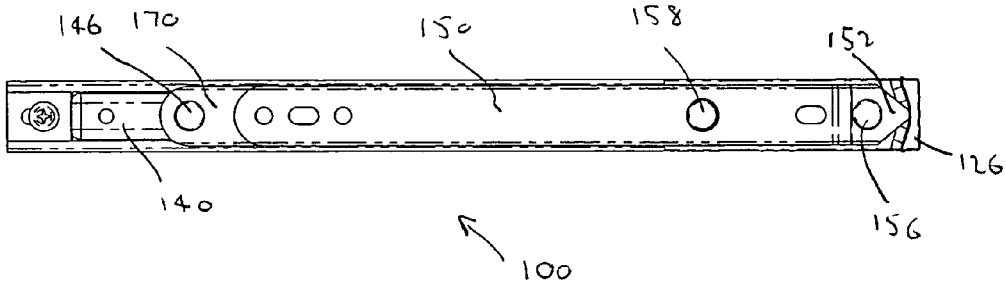
FIG. 6

EGRESS 4-BAR HINGE ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "SEQUENCE LISTING"

Not applicable.

BACKGROUND OF THE INVENTION

1. Field of the Invention

The present invention relates to hinge assemblies for windows which are arranged to support a window for pivotal movement about either a vertical or a horizontal axis, and more particularly, to a hinge assembly configured to enhance an unimpeded opening area to facilitate egress while providing increased load bearing capacity.

2. Background Art

Hinge assemblies are adapted for the support of casement type windows or projection type windows to permit pivotal movement of the window about a vertical axis or a horizontal axis. The hinge assemblies are typically arranged to allow the pivotal movement of the window from the window frame so that when the window is open, both surfaces of the window are accessible. In addition, and it is typically desirable for the track, sash arm and links to be all aligned when the window sash is closed, as misaligned components can result in long-term bending stresses on pivots which in turn can result in bending and undesirable binding during operation of the hinge.

In addition, the hinge assemblies must be able to withstand relatively high temporary loading, and often associated with wind. However, current designs are not able to provide enhanced load capacity while maintaining the limited size dimensions, often dictated by architectural considerations.

Therefore, the need exists for hinge assembly having enhanced load bearing capacity. The need also exists for hinge assembly which can provide enhanced load bearing, with reduced size requirements. A further need exists for an efficient and economical manufacture of such hinge assembly.

BRIEF SUMMARY OF THE INVENTION

The present invention provides a non-handed hinge assembly having enhanced load bearing capacity, while reducing deflection. The present invention provides a hinge assembly such that when in a closed position, the window sash, the window frame and associated weather strip cooperate to maintain a sealed interface. The present hinge assembly increases a maximum allowable weight of the window sash, and further minimizes the likelihood of sash sagging or misalignment of the sash in the frame. The present hinge assembly also provides a "push open" and "pull close" feature which tends to equalize forces on hinge assembly components during operation.

The present invention provides a hinge assembly such that when the window sash is fully opened, the pivotal axis is positioned to maximize the area of unimpeded opening. For example, in a window sash with a vertical pivotal axis which opens to the left, the pivotal axis, while movable into or out of the plane of the window frame, is near the left hand side of the frame when the window is fully opened. The resulting clearance of the window sash from the right hand side of the frame facilitates egress in the event of an emergency.

In one configuration, a four-bar hinge assembly in the present invention includes a track, a support extension affixed to the track, the support extension having a planar bearing surface and an integral end cap. A first link is pivotally attached to the support extension at a first pivot point, and a second link is pivotally attached to the support extension at a second pivot point spaced from the first pivot point. In a further configuration, the first and second links include a corresponding tab and capture recess for cooperative engagement as the hinge assembly is disposed in the closed or closing position. The hinge assembly includes a shoe slidably disposed in the track, and a sash bar pivotally attached to the first link and a strut pivotally attached to the sash bar, to the second link and to the shoe. In contrast to prior four-bar hinges having a common first and second pivot point for corresponding first and second links, the present hinge assembly spaces the first and second pivot points and locates the first and second pivot points on the support extension. The support extension is structured to provide enhanced rigidity.

The present hinge assembly is movable between a closed position and an open position. As the hinge assembly moves towards the closed position, the first and second links cooperate at the tab and capture recess so that an angular displacement of one of the links ensures a corresponding angular displacement of the remaining link. This displacement provides direct assistance to the closure of the hinge assembly and reduces the forces acting on the end cap and thus reduces wear of the end cap. In the closed position, the cooperating tab and capture recess provide additional support in conjunction with the end cap to prevent hinge deflection under high pressure loading, such as wind loads. The cooperative engagement of the first and second links is limited to a portion of the full range of motion to provide a "push open" condition, which reduces contact of the sash flange with the weather strip, therefore reducing wear and potential rolling of the weather strip.

Pivoting the first and second links about separate spaced-apart pivot points reduces wear as compared with using a shared pivot point. The cooperative link between the first and second links eases movement of the hinge assembly near the closed position when binding would most likely occur during opening and closing.

The support extension with integral end cap provides three points of support. Specifically, two points of contact provided by the bearing supports at the first and second pivot points for the corresponding links, and the third point provided by contact between the end cap and a sash bar.

The support extension provides a large planar bearing surface to support and allow for parallel rotation the first and second links about the corresponding pivot points while under load from the sash weight. This parallel rotation reduces sash sag and misalignment. That is, the planar bearing surface provides supports for the first and second links and minimizes any tendency of the links to bend. The support extension with integral end cap provides a one piece construction having increased strength at the end cap, which prevents deflection of the end cap during high pressure loading of the sash, such as wind loads.

BRIEF DESCRIPTION OF THE SEVERAL VIEWS OF THE DRAWING(S)

FIG. 6 is a top view of the hinge assembly in the full-closed position.

FIG. 7 is a top view of the hinge assembly in the semi-open and full-open positions.

DETAILED DESCRIPTION OF THE INVENTION

Referring to FIGS. 1–5, a hinge assembly 100 cooperates with a track 110 having folded side flanges 112. The folded side flanges 112 define a width of the track and a height of the track. The track 110 as a pair of spaced apart ends.

Figure 1:
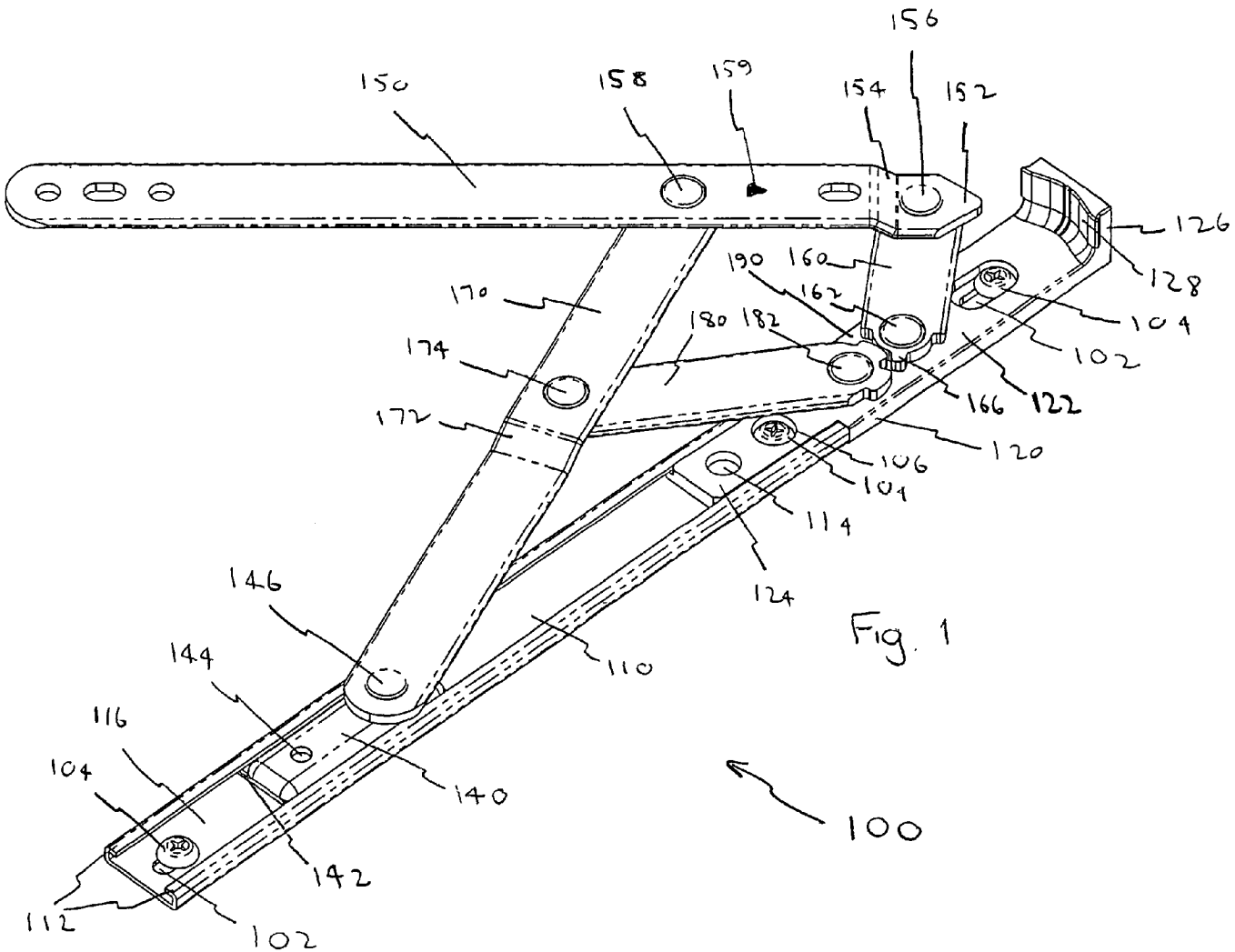
FIG. 1 is a perspective view of a hinge assembly in a semi-open position.
Figure 2:
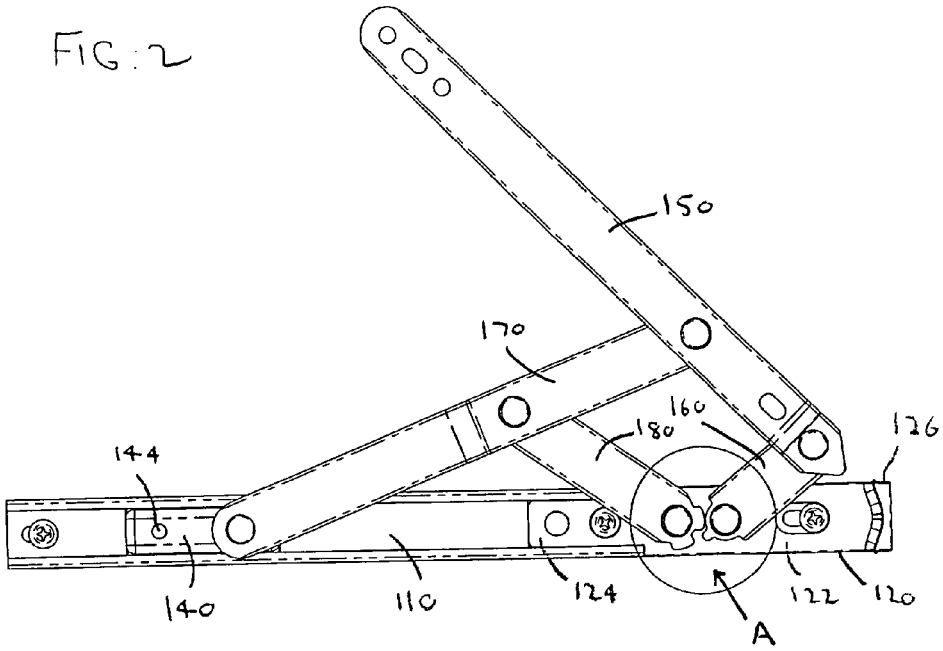
FIG. 2 is a top view of the hinge assembly in the semi-open position.

A support extension 120 is attached to the track 110. The support extension has a bearing surface 122, a flanged end 124 which mates with one end of the track 110, and an end cap 126 opposing the flanged end 124. The flanged end 124 is sized to be received along a length of the track 110 and capture by the flanges 112. In one configuration, the support extension is an integral element, and preferably monolithic. The bearing surface 122 is a substantially planar surface. Further, the bearing surface 122 is sized to have a width substantially equal to the width of the track 10 and a height substantially equal to, or slightly greater than the height of the track. The bearing surface 122 has a predetermined dimension along the longitudinal axis of the track 110. The bearing surface 122, and in a preferred construction, extends from the base of the end cap 126 to the remaining end of the support extension 120. Thus, the bearing surface 122 includes a portion extending along the flanged end 124. As the support extension 120 is a solid piece of material, the support extension exhibits significant strength. The support extension 120 can be connected to the track 110 by any of a variety of mechanisms including crimping, swaging, bonding, mechanical fastening, (rivets or studs) or welding. As shown in FIG. 1, the support extension 120 is attached to the track 110 by detents 114, and is configured so that the bearing surface 122 is level with or, preferably, slightly above the side flanges 112. The support extension 120 is formed of a wear resistant durable material such as brass or cast metal. The track 110 and the support extension 120 are secured to the window frame (not shown), preferably with the end cap 126 adjacent a corner of the window frame.

Figure 8:
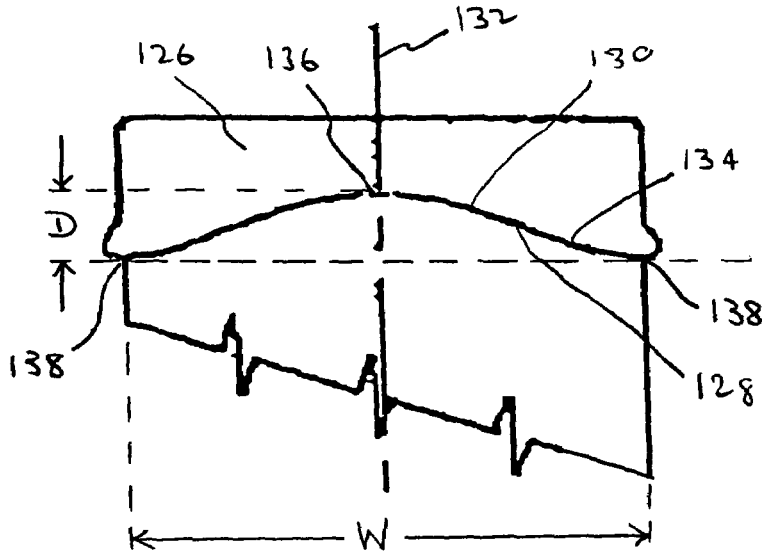
FIG. 8 is a top view of an end cap of the hinge assembly, showing a profile of a corresponding camming surface.

The end cap 126 being an integral portion of the support extension 120, allows for alternative features to be incorporated into the end cap. Specifically, the end cap 126 does not have a constant thickness. As seen in FIG. 8, the thickness of the end cap along the longitudinal dimension of the support extension 120 varies in the transverse direction. The greater thickness (additional material) at the lateral edges of the end cap 126 provides enhanced resistance to temporary loading, such as wind loading.

A shoe 140 is mounted on the track 110. The shoe 140 includes side flanges 142 sized to be slid under and retained by the side flanges 112. The shoe 140 is preferably made from a wearable material such as brass for smooth, long lasting performance. The shoe 140 has a shallow raised portion forming a cavity confronting the track 110 which enables a friction adjusting system (not shown) to be provided. The friction adjusting system includes a friction adjuster pad mounted within the cavity or raised portion, and an adjustment screw engaging a threaded hole 144. The shoe 140 is slidable within the track 110 between a first position and a second position.

Secured to a confronting side of a window sash (not shown) is a substantially flat sash bar 150 with an angular tip 152. When the window sash is in a closed position within the window frame, the sash bar 150 overlies or confronts the track 110 with the tip 152 adjacent the end cap 126. The sash bar 150 has a downward offset 154 and first pivot pin or rivet 156 adjacent the tip 152.

The track 110 and the support extension 120 include a plurality of fastening holes, and in particular elongate fastening holes 102, to facilitate attachment to the window frame with fasteners such as screws 104. The sash bar 150 is comparably fastened to the sash. At one fastening point 106, the track 110 and support extension 120 have aligned fastening holes so that they may be secured together to the window frame. In one configuration, the support extension 120 has at least two fastening holes. The cooperation of the fastening holes and corresponding fasteners allow the support extension 120 to be directly affixed to the frame.

Figures 10, 11, 12, 13, 14:
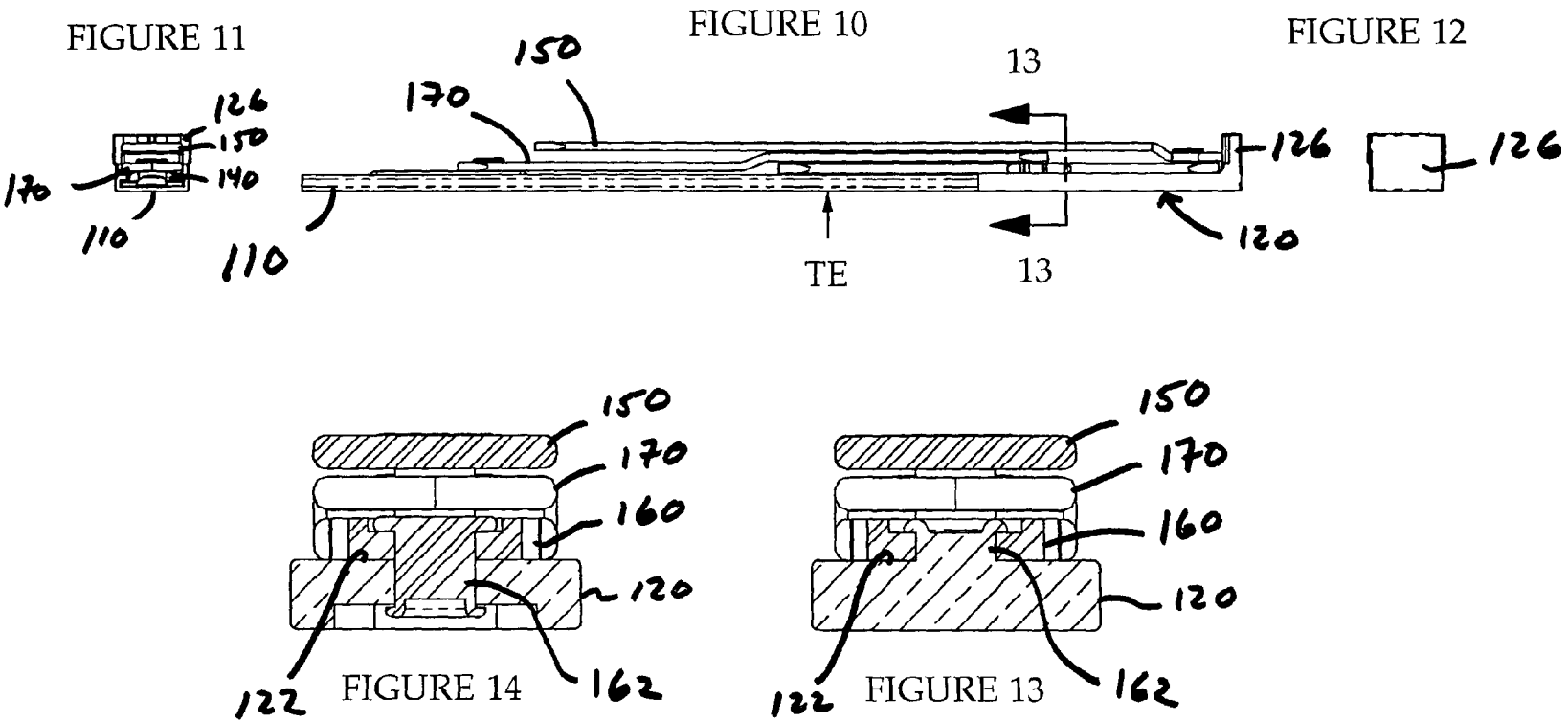
FIG. 10 is a side elevational view of the hinge assembly in the closed position.
FIG. 11 is a left end view of the hinge assembly of FIG. 10.
FIG. 12 is a right end view of the hinge assembly of FIG. 10.
FIG. 13 is a cross-sectional view taken along lines 13—13 of FIG. 10.
FIG. 14 is a cross-sectional view of an alternative construction along lines 13—13 of FIG. 10.

A first link 160 is pivotally connected between the pivot pin 156 and a first bearing pivot pin 162 on the bearing surface 122. Referring to FIGS. 10, 13 and 14, the first link 160 can be pivotally connected to the support extension 120 by a variety of mechanisms including a stud projecting from the bearing surface 122 (FIG. 13), or a rivet extending through the first link 160 and the support extension 120 (FIG. 14). The first link 160 has a length less than the dimension of the bearing surface 122 extending from the first bearing pivot pin 162 to the base of the end cap 126. That is, in the closed position of the hinge assembly 100, the bearing surface 122 underlies the entire length of the first link 160.

The sash bar 150 is provided with a second pivot pin 158. A strut 170 extends between the pivot pin 158 and a pivot pin 146 attached to the shoe 140.

A portion of the strut 170 is offset upwardly as indicated by 172. Within the length of the upwardly offset portion is a pivot pin 174. A second link 180 extends between the pivot pin 174 and a second bearing pivot pin 182 on the bearing surface 122. As seen in the figures, the first bearing pivot pin 162 and a second pivot pin 182 are spaced apart along a longitudinal dimension of the support extension 120. The bearing surface 122 is sized to underlie at least 25%, and preferably leased 50%, and more preferably more than 60% of the length of the second link 180 in the closed position.

The hinge assembly 100 is configured so that when the sash bar 150 is in a superposed relation with the track 110

(the closed position), as in FIG. 6, the strut 170 is interposed between the track 110 and sash bar 150, and is in alignment with the sash bar 150. Similarly, first and second links 160 and 180 are aligned with the track 110 and the sash bar 150 is a closed position, as seen in FIGS. 10–14. The four elements 150, 160, 170 and 180 are elements of what is known in the industry as a "four bar hinge". The four elements 150, 160, 170 and 180 define four sides of a pentagonal figure, the fifth side being represented by a length 190 of the support extension 120 extending between the first bearing pivot pin 162 and the second bearing pivot pin 182, wherein both bearing pivot pins 162 and 182 are stationary at fixed spaced positions along a longitudinal dimension of the support extension 120, and hence the track 110.

The sash bar 150, first link 160, strut 170, and second link 180 are preferably all made from stainless steel and are preferably provided with rounded edges, for precluding interference of the adjacent hinge elements under load during an opening or closing operation.

While only the four bars 150, 160, 170 and 180 are disclosed above as elements of a four bar hinge, it should be understood that additional bars may be included for heavier windows, such as a cross-link connecting the sash bar 150 to a second shoe.

The first and second links 160 and 180 have contact ends 164 and 184, respectively. A tab 166 extends outwardly from the end 164 and is received by a corresponding capture recess 186 in the end 184 of second link 180. It is understood that the tab 166 and capture recess 186 could equally well be transposed relative to the first link 160 and the second link 180. Due to the geometry of the links, the struts and the sash bar, the first and second links 160, 180 do not rotate at equal angular velocities in the opening and closing motions. Thus, the tab 166 and capture recess 186 are sized to cooperate through a limited range of motion. Specifically, the range of motion is approximately the first 20 degrees of motion from the collinear closed position toward the open position.

1. In rotating from the closed, collinear orientation to the open inclined orientation with respect to the track 110, the first and second links 160, 180 have a substantial contact area between the bearing surface 122 of the support extension 120 and the respective link. Specifically, as seen in FIG. 10, in the closed configuration, the entire length of the first link 160 provides contact area with the bearing surface 122. At least half, and preferably approximately two-thirds (or more) of the length of the second link 180 is in contact with the bearing surface 122 in the closed position of the assembly. Referring to FIG. 10, the bearing surface 122 terminates at point TE with the end of the support extension 120 as the support extension is received within the track 110.
2. As the bearing surface 122 is generally planar, the areas for available contact between the support extension 120 and each of the first and second links 160 and 180 is, at least increased, and with respect to the first link 160 is maximized. The increased contact area between the first and second links and the track (by virtue of the sad bearing surface 122 of the support extension 120) distributes the weight and stresses that would otherwise be concentrated at the first and second pivot pins 162 and 182. The contact area between the first and second links and the support extension 120 increases the resistance against the types of stresses which might otherwise cause undue warpage of the links 160 and 180 under the weight of the window. Thus, deflection of the links 160, 180 in the closed position is precluded by contact with the solid (non deflecting) bearing surface 122. As stated, the materials of the links 160, 180 and bearing surface 122 are selected to facilitate direct rotational contact. In addition, the use of the spaced apart pivots 162 and 182 avoids a concentration of stresses at a single pivot. Thus, the separate and spaced pivots 162 and 182 reduce the likelihood of galling or burring during rotation of the links 160 and 180 between the open and closed positions.

The second link 180 is notched near the end 184 to provide contact surfaces 188 for limiting the opening of the hinge assembly 100. In the fully open position, the contact surface 188 acts as a stop against an edge 168 of the first link 160. Preferably, in the fully open position the sash bar 150 extends outwardly from the track 110 in a generally perpendicular direction, as represented by the dashed outlines of FIG. 7. Optionally, stops may be provided at other locations such as the track 110 or the sash bar 150. For example, a stop dimple 159 can be provided in the sash bar 150. As shown in FIG. 1, the stop dimple 159 has a recess uppermost and a downward projection (not visible in FIG. 1) from the sash bar 150. The stop dimple 159 thus contacts strut 170 to preclude further rotation of the hinge assembly.

To assist the window sash fitting properly against the window frame when the window sash is closed, the end cap 126 is located to be adjacent the corner of the window frame. As the window is closed and immediately prior to the sash bar 150 coming into alignment with the track 110, the angular tip 152 of the sash bar engages a collection surface 128 of the end cap 126. Engagement of the tip 152 and the end cap 126, reduces the tendency of the tip 152 to "overshoot", thus reducing the tendency of the sash bar 150 to be slightly misaligned and precluding an effective seal between the sash and the frame.

As seen in FIG. 8, the collection surface 128 has a concave portion 130 straddling a longitudinal centerline 132 and a convex portion 134 merging directly into either side of the concave portion 130. The convex portion 134 is referred to as a collecting surface and is an area with which the tip 152 first comes into contact with the end cap 126 as the window is closed. At the convex portion 134, a pressure between the tip 152 and the end cap 126 comes into play which inhibits, without impeding, movement of the tip 152; sufficient frictional force is provided between the tip 152 and the end cap 126 to preclude misalignment. Once the tip 152 has moved beyond the concave position 134 towards the centerline 132, the pressure is relieved and the window is properly seated in the frame with enough play to avoid excessive pinching of weather-strip material between the sash and the frame.

Figure 9:
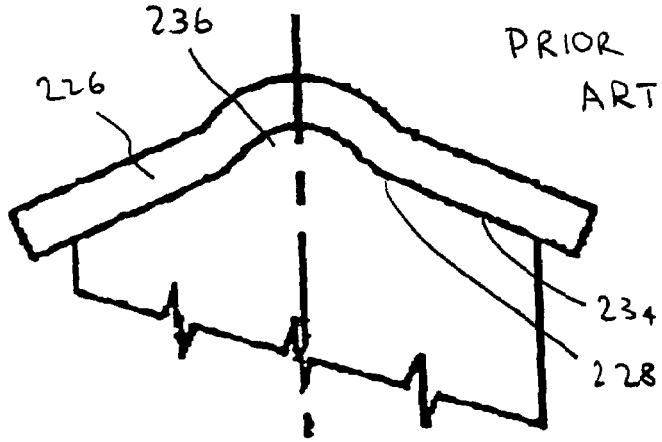
FIG. 9 is a top view of a prior art end cap showing a profile of a corresponding camming surface.

In contrast to the present invention, prior art end caps 226 have a camming surface 228 with linear surfaces 234 angled to meet at a recess 236 as shown in FIG. 9. The recess 236 typically has concave curvature. The collecting surface 128 of the present invention has a profile described by a curve with a continually changing first derivative, in contrast to the camming surface 228 of the conventional end cap 226 wherein the surface 234 has a constant first derivative. Because the profile of the prior art surface 234 is linear, once contact is established, the pressure between the tip and the collecting surface increases to a higher level than necessary (possibly leading to binding which results in wear and tear) until the tip moves into the recess 236.

The hinge assembly 100 of the present invention is preferably made mostly from stainless steel, apart from the support extension 120, which is preferably from aluminum or bronze and, the shoe 140 which is preferably brass. A hinge assembly 100 with the pentagonal geometry of the present invention could be made with a conventional track, that is, without a separate support extension. However, the distinct support extension 120 provides a stronger base upon which to fasten the first and second links 160 and 180, thereby providing a stronger assembly.

In addition, the present configuration allows the separately pivoted first link 160 and second link 180 to be disposed in the same plane, rather than one atop the other on a shared pivot. The second link 180 thus does not add to total thickness of the assembly. As window sashes, window frames and hinge assemblies must typically conform to certain standard dimensions, the "saved" link thickness allows thicknesses of other elements of the hinge assembly to be increased. For example, in typical prior art assemblies, each of the elements is 0.10" thick. In the present invention, the "saved" link thickness of 0.10" is made up by increasing the support extension thickness and the link thicknesses to 0.15". The load bearing links 160 and 180 being thicker, the load on each of the links being borne substantially by the bearing surface 122, and two bearing pivot pins 162 and 182, rather than a single bearing pivot pin, allow the present invention to sustain a greater load or stress than comparable prior art hinges. The present construction not only allows a given hinge to be used with a heavier sash, but also helps windows withstand damage under abnormal wind pressures such as might occur in hurricane-prone areas.

The hinge assembly 100 is used as follows, assuming that the window sash is already installed in the frame by means well known in the art and that the window is operable by means such as a crank mechanism familiar in the art. The hinge assembly 100 can be positioned on either side of a window. However, the hinge assembly 100 is primarily intended for use at the top and bottom of window sashes that pivot about a vertical axis.

Figure 3:
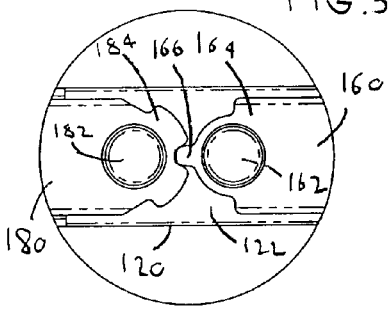
FIGS. 3, 4 and 5 show detail of a portion of the hinge assembly in a full-closed, semi-open and full-open position, respectively.
Figure 5:
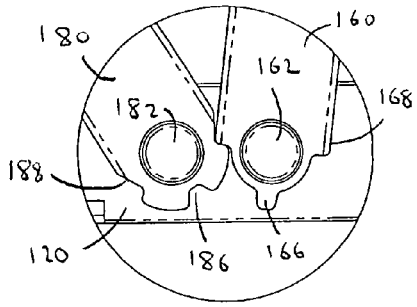
Figure 4:
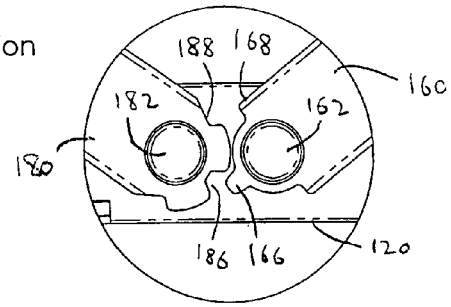

Starting from the closed position, a user operates a crank mechanism and the sash bar 150 begins to move outward from a mutually aligned position as in FIGS. 3, 6 and 10. The first link 160 and the second link 180 move cooperatively as the tab 166 and the capture recess 186 interact. This cooperative movement provides for smooth operation of the hinge assembly 100, since it precludes undue stresses on any one element, which might otherwise be significant. These stresses are particularly likely to occur with the hinge near the closed position when proximate elements might be prone to binding. As the window opens further, cooperation between the first link 160 and the second link 180 is no longer necessary, and the tab 166 recedes from the capture recess 186, into a position such as that of FIG. 4. Finally, when the window is approximately perpendicular to the frame, the edge 168 of the first link 160 abuts the contact surface 188 of the second link 180 as shown in FIG. 5, precluding any further movement.

While the first link 160 and second link 180 initially cooperate as indicated above, moving through angular displacements, the links can rotate through different angular displacements as the hinge assembly 100 moves further open and the tab 166 and capture recess 186 disengage.

To close the window starting from the full open position, the user reverses the crank. The edge 168 of the first link 160 and the contact surface 188 of the second link 180 immediately disengage. As the sash bar 150 approaches the closed position, the tab 166 and the capture recess 186 approach alignment and the first link 160 and second link 180 begin to cooperate through the interaction of the tab 166 and the capture recess 186. The first link 160 and second link 180 thereby cooperate in rotation. Meanwhile, the tip 152 engages the collection surface 128 of the end cap 126, the frictional force exerted by the collection surface 128 tending to slightly retard movement of the tip 152. This retardation assists in proper alignment of the window sash in the window frame. As the tip 152 moves further towards the centerline 132, the convex geometry of the collecting surface 134 allows a lessening and release of the frictional force as the tip moves 152 into the concave area 130, allowing the window sash to be properly seated in the window frame.

While the invention has been described in conjunction with a specific embodiment thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

The invention claimed is:

1. A hinge assembly comprising:

(a) an elongate track having a length and a width;

(b) a support extension fixedly connected to the track and extending beyond the length of the track, the support extension having an integral planar bearing surface and an end cap extending transverse to the bearing surface;

(c) a first link pivotally connected to the support extension beyond the length of the track at a first pivot point, the first link movable between a closed position and an open position, the first link having a given length, and the bearing surface underlying at least a portion of the given length of the first link in the closed position;

(d) a second link pivotally attached to the support extension beyond the length of the track at a second pivot point spaced apart from the first pivot point to locate the first pivot point intermediate the second pivot point and the end cap, the second link movable between a closed position and an open position, the bearing surface underlying at least a portion of a length of the second link in the closed position;

(e) a shoe slidably engaging the track;

(f) a sash bar pivotally attached to the first link; and (g) a strut pivotally attached to the sash bar, the second link and the shoe.

2. The hinge assembly of claim 1, wherein the bearing surface underlies a sufficient length of the second link in the closed position to preclude detrimental deflection under an operating load.

3. The hinge assembly of claim 1, wherein the track is formed of a first metal and the support extension is formed of a different second metal.

4. The hinge assembly of claim 1, wherein the first link and the second link include cooperating features to define an engagement through a limited range of motion between the open position and the closed position.

5. A hinge assembly comprising:

(a) a track having a length and a width;

(b) a support extension attached to the track, the support extension having a planar bearing surface;

(c) a first link pivotally attached to the support extension at a first pivot point, the first link movable between the closed position and an open position, the first link having a given length, and the bearing surface underlying the given length of the first link in the closed position;

(d) a second link pivotally attached to the support extension at a second pivot point spaced apart from the first pivot point, the second link movable between a closed position and an open position, the bearing surface underlying at least a portion of a length of the second link in the closed position;

(e) a shoe slidably engaging the track;

(f) a sash bar pivotally attached to the first link;

(g) a strut pivotally attached to the sash bar, the second link and to the shoe and (h) a tab in one of the first and second length being engageable with a capture recess in the other of the first and second links for transferring a limited range of angular motion between the first and second links, wherein the tab and capture recess are shaped to accommodate unequal angular velocities of the first and second links about the first and second pivot points, and wherein the support extension includes an integral end cap that is connected to the support extension beyond the length of the track.

6. The hinge assembly of claim 5, wherein the first link and the second link in the open position dispose the sash bar generally perpendicular a longitudinal dimension of the track.

7. The hinge assembly of claim 5, wherein the first link includes one of a tab and a capture recess and the second link includes a remaining one of the tab and the capture recess.

8. The hinge assembly of claim 7, wherein the tab and the capture recess are sized to profitably engage through only a portion of motion between the open position and the closed position of the first and second links.

9. A hinge assembly comprising:

(a) a track having a width;

(b) a support extension attached to the track, the support extension having a planar bearing surface;

(c) a first link pivotally attached to the support extension at a first pivot point, the first link movable between the closed position and an open position, the first link having a given length, and the bearing surface underlying the given length of the first link in the closed position;

(d) a second link pivotally attached to the support extension at a second pivot point spaced apart from the first pivot point the second link movable between a closed position and an open position, the bearing surface underlying a length of the second link in the closed position;

(e) a shoe slidably engaging the track;

(f) a sash bar pivotally attached to the first link; and (g) a strut pivotally attached to the sash bar, the second link and to the shoe, wherein the support extension is an integral monolithic piece.

10. The hinge assembly of claim 5, wherein the support extension includes at least two apertures, a first of the two apertures in the support extension located beyond a length of the track for fastening the extended portion to a window frame and a second of the two apertures in extended portion being aligned with an aperture in the track for fastening the extended portion to the track and to the window frame.

11. The hinge assembly of claim 5, further comprising an end cap integrally formed with the support extension, the end cap having a collection surface described by a curve with a continually varying first derivative.

12. The hinge assembly of claim 5, wherein the first and second links including contacting surfaces that engage each other to form a stop to limit movement of the hinge assembly beyond a predetermined open configuration.

13. A hinge assembly comprising:

(a) a track having a width;

(b) a support extension attached to the track, the support extension having a planar bearing surface;

(c) a first link pivotally attached to the support extension at a first pivot point, the first link movable between the closed position and an open position, the first link having a given length, and the bearing surface underlying the given length of the first link in the closed position;

(d) a second link pivotally attached to the support extension at a second pivot point spaced apart from the first pivot point, the second link movable between a closed position and an open position, the bearing surface underlying a length of the second link in the closed position;

(e) a shoe slidably engaging the track;

(f) a sash bar pivotally attached to the first link; and (g) a strut pivotally attached to the sash bar, the second link and to the shoe, wherein the support extension has a longitudinal centerline, and a dimension of the end cap along the longitudinal direction increases with an increasing distance from the centerline.

14. A hinge assembly comprising:

(a) a track having a width;

(b) a support extension attached to the track, the support extension having a planar bearing surface;

(c) a first link pivotally attached to the support extension at a first pivot point, the first link movable between a closed position and an open position;

(d) a second link pivotally attached to the support extension at a second pivot point spaced apart from the first pivot point, the second link movable between a closed position and an open position, the first and second links having given lengths, and the bearing surface sized to underlie at least one-half of the given length of one of the first link and the second link in the closed position of the first link and the second link;

(e) a shoe slidably engaging the track;

(f) a sash bar pivotally attached to the first link; and (g) a strut having pivotal attachments to the sash bar, to the second link and to the shoe.

15. The hinge assembly of claim 14 in which the bearing surface of the extended portion underlies at least one-half of the given length of the second link.

* * * * *